US006918684B2

(12) United States Patent
Harvey

(10) Patent No.: US 6,918,684 B2
(45) Date of Patent: Jul. 19, 2005

(54) LUMINAIRES FOR ILLUMINATION OF OUTDOOR PANELS

(75) Inventor: John Bryan Harvey, Newark, OH (US)

(73) Assignee: Acuity Brands, Inc., Atlanta, GA (US)

( * ) Notice: Subject to any disclaimer, the term of this patent is extended or adjusted under 35 U.S.C. 154(b) by 55 days.

(21) Appl. No.: 10/625,299

(22) Filed: Jul. 22, 2003

(65) Prior Publication Data

US 2005/0018428 A1 Jan. 27, 2005

(51) Int. Cl.[7] ..... F21V 7/09

(52) U.S. Cl. ..... 362/297; 362/147; 362/328; 362/347; 362/812

(58) Field of Search ..... 362/297, 147, 362/290, 291, 296, 328, 341, 346, 347, 812; 40/540, 541

(56) References Cited

U.S. PATENT DOCUMENTS

| | | | | | |
|---|---|---|---|---|---|
| 4,027,151 | A | * | 5/1977 | Barthel | 362/217 |
| 4,173,037 | A | * | 10/1979 | Henderson et al. | 362/287 |
| 4,379,322 | A | * | 4/1983 | Kelly | 362/300 |
| 4,451,875 | A | * | 5/1984 | Odle et al. | 362/297 |
| 4,799,136 | A | * | 1/1989 | Molnar | 362/300 |
| 6,773,135 | B1 | * | 8/2004 | Packer | 362/145 |

* cited by examiner

*Primary Examiner*—Sandra O'Shea
*Assistant Examiner*—Mark Tsidulko
(74) *Attorney, Agent, or Firm*—Kenneth E. Darnell

(57) ABSTRACT

Luminaires for illumination of vertical surfaces of predetermined dimensions such as billboards or similar signs, the invention in several embodiments takes the form of reflector assemblies capable of directing light from a light source disposed within each of said luminaires either directly to the vertical surface or to refractive structures located on the luminaires for redirection of light to the vertical surface for even illumination of said surface with minimal light pollution from "spill" light. Lamps used in embodiments capable of providing asymmetrical light distributions are located toward one or the other of side portions and are preferably vertically oriented. A main reflector is curvilinear in conformation and functions in concert with a secondary reflector located directly behind the lamp to direct light onto desired portions of a vertical surface. Luminaires configured according to the invention also utilize side reflectance panels for light control and for maximizing light directed onto a vertical surface, said luminaires also preferably including refractive lens elements for redirection of light onto the vertical surface. The reflector assemblies of the invention are mounted within weather-tight housings, the refractive structures conveniently being disposed on or formed integrally with a transparent glass or plastic cover that completes the housing, said cover being located between the lamp and the vertical surface to be illuminated. Efficiencies occasioned by the present luminaires permit illumination of billboards and similar signs of standard dimensions with only two of the luminaires and with full and even illumination with minimal light spillage, a capability approached previously in the art only with a greater number of luminaires.

52 Claims, 10 Drawing Sheets

LUMINAIRES FOR ILLUMINATION OF OUTDOOR PANELS

BACKGROUND OF THE INVENTION

1. Field of the Invention

The invention relates generally to luminaires intended for illumination of billboards, outdoor signs and similar vertical surfaces and particularly to luminaires of increased efficiency capable of superior lighting intensities and uniform illumination with reduced light "spillage".

2. Description of the Prior Art

Luminaires capable of illuminating vertical surfaces such as billboards and similar signs occupy a particular niche in the lighting field. Luminaires of this kind must operate in a harsh environment and be effectively impervious to the elements including rain, wind and ambient temperatures. Prior luminaires developed for illumination of outdoor signs and the like have with varying effectiveness addressed the requirement of producing an illumination level of an intensity sufficient to allow the sign being illuminated to be viewed with comprehension from varying distances. Prior luminaires have also addressed a second requirement that such signs be illuminated to desired levels on various portions thereof to provide a desirable impression of uniformity. Prior luminaires have addressed these two requirements as fully as technology existing at the time has permitted. However, as energy conservation considerations have increased, a further requirement of such luminaires has been to direct as much as possible of the generated light onto an outdoor sign so that a maximum amount of the generated light is actually used, full utilization of the generated light typically permitting lessened light generation for a given situation with a resultant conservation of energy. In the present marketplace, energy conservation must not result in a reduction in lighting intensity and uniformity. Relatively more recent requirements relating to light "pollution" caused in part by light generated by luminaires that illuminate outdoor signs and the like have resulted in the necessity for the light generated by such luminaires to be directed to the greatest degree possible onto the sign or billboard that is to be illuminated rather than to "spill" about edges of such an outdoor sign, such "spill" producing stray light that accomplishes no function and acts to obscure the night sky. Light from such luminaires not focused onto the billboard or similar sign produces glare and clutter and effectively wastes energy through such inefficiency that the cost of such waste is estimated to exceed as much as one billion dollars on an annual basis. Spill light of this nature can negatively impact tasks performed near the location of an outdoor sign while contributing to "sky glow" and degrading the nocturnal environment so as to affect the quality of life in rural communities in particular as well as having a negative impact on business and recreational activities.

Luminaires employed for the illumination of outdoor signs and the like have existed for at least the better part of a century as is evidenced by existing United States patents disclosing luminaires for this very purpose. Ennever, in U.S. Pat. No. 2,746,187, describes a system for illumination of an outdoor display such as a billboard or similar outdoor sign, this patent describing luminaires mounted along an upper edge of a billboard and which cast light directly down onto the billboard through direct illumination as well as through reflection from a reflective structure surmounting a light source. Luminaires of the time of Ennever did not produce uniform light intensities over the full surface of a sign and were not energy efficient. In U.S. Pat. No. 3,647,148, Wince discloses luminaire structures having both reflective surfaces and refractive structures configured to direct light onto a particular objective as well as for general illumination. The luminaires disclosed by Wince were not particularly intended for illumination of vertical surfaces. However, the Wince patent provides a disclosure of the use of reflective surfaces and refractive structures for illumination. Odle et al, in U.S. Pat. No. 4,037,341, disclose luminaires intended for illumination of outdoor signs and the like having vertical surfaces intended to be illuminated. By the time of Odle et al, outdoor sign illumination had progressed to the point where a plurality of luminaires mounted in spaced relation to each other and spaced from the sign face to be illuminated were disposed in front of the sign and in proximity to a lower edge of the sign, light generated by the luminaires being directed at angles generally upwardly from said luminaires as opposed to the downward illumination provided by Ennever as mentioned above. The patent to Odle et al illustrates an intent to evenly illuminate an outdoor sign with an appropriate intensity and to produce positive side edge cut-off, that is, to minimize light passing from the luminaire and past edges of the sign, the energy generated to produce light not incident on the sign being wasted. Odle et al disclose a combination of reflective surfaces and refractor structures intended to maximize illumination of an outdoor sign given a predetermined amount of generated light. Reibling, in U.S. Pat. No. 4,188,657, describes luminaires intended for the illumination of outdoor signs and being capable of producing light patterns by means of combinations of reflective surface finishes on reflective surfaces of the disclosed luminaires. In U.S. Pat. No. 4,261,030, Hernandez discloses lighting fixtures having horizontally disposed lamps with parabolic reflectors mounted one each behind each of the lamps such that light is directed onto a surface that is to be illuminated. Hernandez discloses auxiliary reflectors in addition to a primary reflector, the combination of reflective surfaces directing light onto a surface that is to be illuminated. U.S. Pat. No. 4,398,239 to de Vos et al discloses a luminaire intended for illuminating roadways and the like including a reflector capable of being removed from a weather-tight housing that also mounts a light source in an operative relation with the reflector. Odle et al, in U.S. Pat. No. 4,451,875, disclose a luminaire intended for illumination of a billboard or the like, the luminaire including reflective surfaces and a light source disposed between the reflective surfaces and a surface of the sign that is to be illuminated. The Odle et al luminaire utilizes refractive structures disposed on and formed integrally with a transparent cover that also comprises a portion of a weather-tight housing. The refractive structures of Odle et al function in concert with reflective surfaces to direct light onto a vertical surface that is to be illuminated such as the face of a billboard or similar outdoor sign. In U.S. Pat. No. 4,559,587, Quiogue et al disclose a luminaire having both reflective surfaces and refractor structures that function cooperatively to direct light onto an objective. Hammond, in U.S. Pat. No. 4,575,783, discloses a reflector configured to direct light emanating from a light source to all areas of an outdoor sign to create a uniform distribution of light on the face of the sign. Light is redirected by the Hammond reflector to portions of the sign surfaces that are not evenly illuminated with an appropriate intensity by light directly incident on the face of the sign from the light source. In U.S. Pat. No. 4,954,935, Hammond et al disclose a lighting system for illuminating an outdoor billboard or the like formed of a number of panels. The system disclosed by Hammond et al utilizes a number of luminaires, one for each panel of the sign. Hammond et al disclose use of a metal halide lamp with reflectors fixed within a lamp housing. The reflectors are positioned behind the lamp and reflect light radiating from the lamp onto the sign surface that is to be illuminated. The reflector of Hammond et al is provided with a number of flutes or reflecting segments. U.S. Pat. No. 4,337,507 to Lasker describes lighting fixtures with directional distributions. Luminaires disclosed by Lasker are provided with a prismatic unit and a reflector unit intended to reduce the amount of light escaping at excessively high angles as is often found with floodlighting luminaires. The prismatic unit disclosed by Lasker employs vertical ribs for directing light produced by a light source and further provides a lateral distribution of light at extremely wide angles as well as illumination behind the aperture of a housing that encloses the prismatic unit and the reflector unit. The light distribution provided by the Lasker structure does not provide a light distribution that can be focused evenly and wholly onto a surface of a vertically oriented billboard or the like. Lasker employs a reflector having a cylindrically and parabolically shaped contour for production of a uniform horizontal distribution of light. Lasker pivots a light source and reflector unit within the housing about a fixed horizontal axis to adjust vertical cut-off angles and angles of maximum intensity. However, the structure of Lasker is not configured for full and even illumination of a vertical surface of a sign or the like as is required for illumination of outdoor advertising signs and the like. Thoman et al, in U.S. Pat. No. 3,358,133, disclose a floodlight having a primary reflector formed in a scoop-like configuration, the reflector being hinged to a supporting frame. A semi-cylindrical auxiliary reflector cooperates with the primary reflector to produce a wide beam uniformly distributed over a large area as is intended by the use of the Thoman et al luminaire as a floodlight. Thoman et al do not disclose optics intended for effective illumination of a vertical surface of an outdoor sign or the like. Subisak et al, in U.S. Pat. Nos. 5,188,453; 5,355,291; 5,588,742 and 5,664,878, describe luminaires intended for mounting on a periphery of a sign to illuminate a sign face from internally of such a sign. Relatively more recent patents to Hein et al and Sara et al, that is, U.S. Pat. Nos. 6,168,295 and 6,508,574, respectively, disclose luminaires capable of illuminating vertical surfaces such as billboards and the like utilizing reflector assemblies formed of a plurality of reflective segments disposed in bands and rows with particular locations and orientations of the reflective segments.

As is evidenced by the disclosures of the prior art including those United States patents referred to above, it is seen that substantial efforts have previously been expended toward the goal of uniform illumination of vertical surfaces of billboards, outdoor signs and the like, such illumination being intended to be uniform as well as of a sufficient intensity to permit legible viewing of indicia formed on a sign face and with a desirable utilization of generated light. Although optical systems intended for outdoor sign illumination have taken a number of forms and have been positioned both below and above sign faces, it can be appreciated that improvements in the luminaires themselves are needed in order to maximize light utilization and to reduce light spillage in order to conserve resources including costs required for sign installations. A further intent in the art has been to provide luminaires having efficiencies permitting the utilization of fewer luminaries for illumination of a surface of given dimensions. The present invention addresses these long-felt needs in the art by providing reflective assemblies of particular configuration particularly used with a vertically oriented lamp located within the luminaire to produce asymmetrical light distributions in certain embodiments of the invention. The reflective structures of the invention further cooperate with refractor structures carried by luminaire housings for redirecting light onto sign surfaces with a minimum of light spillage. The luminaires of the invention exhibit efficiencies permitting utilization of fewer luminaire structures for illumination of sign surfaces of given dimensions. The present invention thus provides substantial advances in the art as will be further appreciated in view of the following disclosure of the several embodiments of the invention.

SUMMARY OF THE INVENTION

In the embodiments of the invention explicitly disclosed herein, the invention provides luminaires intended for illumination of billboards, outdoor signs and similar vertical surfaces and which are capable of uniformly illuminating full surfaces of said signs with desired intensities and with reduced light spillage about edges of such signs. The luminaires of the invention provide improvement over the prior art by the provision of reflector assemblies configured to direct light to particular portions of such vertical surfaces with a degree of control sufficient to minimize light pollution and glare. Particular embodiments of the invention are characterized by orientation of a light source vertically within housings sealed against environmental affects by means of a transparent lens that also functions as a cover. The lens is preferably formed with refractor elements preferably disposed on interior surfaces of the lens. Refractive elements are provided on portions of the lens and take the form of prisms of differing configuration selected for redirecting light from at least portions of the reflective assemblies of the luminaire to illuminate particular portions of an outdoor sign. A reflector assembly configured according to the invention includes a main reflector preferably of a parabolic contour, a secondary reflector preferably mounted to the main reflector and located directly "behind" the light source and reflective side panels, the reflective assembly acting to maximize light directed onto a vertical surface with effective control of that light to provide desirable light intensities uniformly over said surface with high average sign illuminance. The reflector assemblies of the invention preferably include reflective side panels that are positioned to increase sign illumination and to decrease spill light. Refractive prisms formed on a transparent luminaire lens or cover refocus light from both the light source and the reflector assembly to increase uniformity of illumination and to reduce spill light. Spill light into the night sky is reduced substantially relative to prior art sign luminaires through use of the present luminaires and with improved uniformity of illumination.

Efficiencies occasioned by use of the present luminaires permit the use of fewer luminaires for adequate illumination of signs of predetermined dimensions. In the prior art, luminaires intended for illumination of billboards, outdoor signs and the like are capable of desirable illumination of signs of standard dimensions through the use of at least four luminaires. The luminaires of the present invention are capable of desirable illumination of billboards and outdoor signs of the same dimensions through the use of as few as two of the present luminaires. In other words, in a typical outdoor sign illumination environment, at least four luminaires have typically been required in the prior art while systems configured with the present luminaires allow the use of as few as two luminaires for illumination of signs of dimensions previously requiring the use of four prior art luminaires. Such performance is occasioned in part by the location of the light source within the luminaire toward one side or the other rather than in a central location, this off-center positioning of the light source providing an asymmetric distribution of light enabling use of one luminaire at each end of the sign in a typical illumination environment. Each of the luminaires so positioned are configured with the light source disposed toward the outward side of the luminaire. In luminaires so configured, an outward reflective side panel preferably has a flat high reflectance finish, the inward reflective side panel having either a high reflectance finish or a low reflectance finish intended to mitigate spill light.

A luminaire configured according to a further embodiment of the invention produces a symmetric light distribution through placement of the light source centrally within the luminaire, that is, disposed equidistantly from either side of the luminaire. In such an embodiment, the secondary reflector continues to be located directly behind the light source, the light source also continuing to be vertically oriented in preferred embodiments of the invention. Reflective side panels in such an embodiment are preferably provided with high reflectance finishes.

The light source preferred for use in the several embodiments of the invention takes the form of an appropriate lamp mounted vertically within the luminaire, such orientation facilitating an asymmetric light distribution as is desirable for realization of the reduction in the number of luminaires needed to illuminate a vertical surface of a typical outdoor sign. Vertical orientation of the lamp also typically increases lamp output and life when compared to similar luminaires having horizontally oriented lamping.

Accordingly, it is an object of the invention to provide luminaires intended for illumination of billboards, outdoor signs and the like and which are capable of providing uniform light distribution over full surfaces of said billboards without spillage of light about edges of said billboard.

It is another object of the invention to provide luminaires intended for illumination of vertical surfaces and preferably having a vertically oriented light source disposed within the luminaire in locations capable of producing either symmetric or asymmetric light distributions, thereby facilitating a reduction in the number of luminaires needed for illumination of a typical outdoor sign or the like.

It is yet another object of the invention to provide luminaires capable of uniform illumination of billboards and the like with minimum light spillage whereby a reflector assembly configured with a curvilinear main reflector and a preferably elliptical secondary reflector preferably function with refractive prisms carried by the luminaires to direct and/or redirect light onto vertical surfaces of the billboard, the reflector assembly preferably having reflective side panels, said side panels functioning to maximize light directed onto the billboard.

It is a further object of the invention to provide a luminaire intended for mounting in front of a large panel such as a billboard for illumination of said panel, the luminaire being formed of a housing, a light source preferably vertically disposed within the housing, a reflector assembly disposed within the interior of the housing for directing light from the light source both directly to surfaces of the panel to be illumination and to refractive prisms preferably disposed on interior surfaces of a covering lens completing the housing and transparent to light incident thereon, the reflector assembly including a main reflector, a secondary reflector disposed behind the light source and reflective side panels, reflective surfaces of the reflector assembly as well as the refractive prisms acting to direct light from the light source onto surfaces of the panel with desirable intensity and uniformity and with reduced light spillage.

Yet another object of the invention is to provide an outdoor sign illumination system capable of evenly and efficiently illuminating a billboard or the like, said billboard having a typical length-wise dimension or approximately 48 feet in a horizontal sense, such a billboard being fully illuminated by as few as two luminaires configured according to the invention, the luminaires of the invention being capable of illuminating billboards of differing dimensions with fewer luminaires than have previously been required through use of luminaires configured according to the prior art.

Further objects and advantages of the invention will become more readily apparent in light of the following detailed description of the preferred embodiments of the invention.

DESCRIPTION OF THE PREFERRED EMBODIMENTS

The disclosures of U.S. Pat. Nos. 4,037,341; 4,188,657; 4,261,030; 4,451,875; 4,575,783 and 4,954,953 are incorporated hereinto by reference, these patents disclosing luminaire structures essentially capable of illumination of billboards, outdoor signs and the like, the disclosures of these patents providing information additional to the disclosure provided herein and which further teach a person of ordinary skill in the art to make and use the present invention. The disclosure of U.S. patent application Ser. No. 10/113,494, filed Mar. 29, 2002, is also incorporated hereinto by reference.

Figure 1:
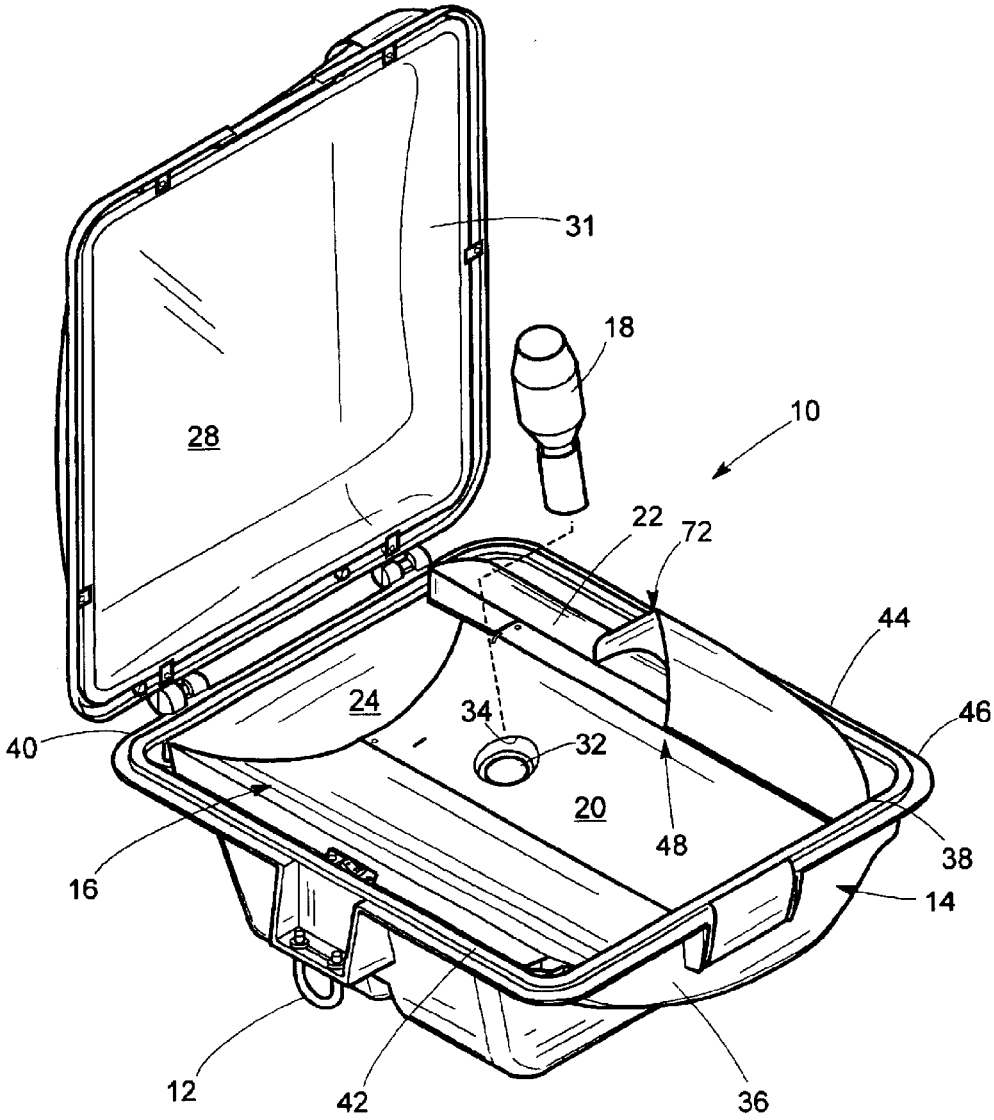
FIG. 1 is a perspective view of an embodiment of a luminaire configured according to the invention for illumination of an outdoor sign or the like and shown with a lamp illustrated in a spaced relation to a usual assembly location.
Figure 2:
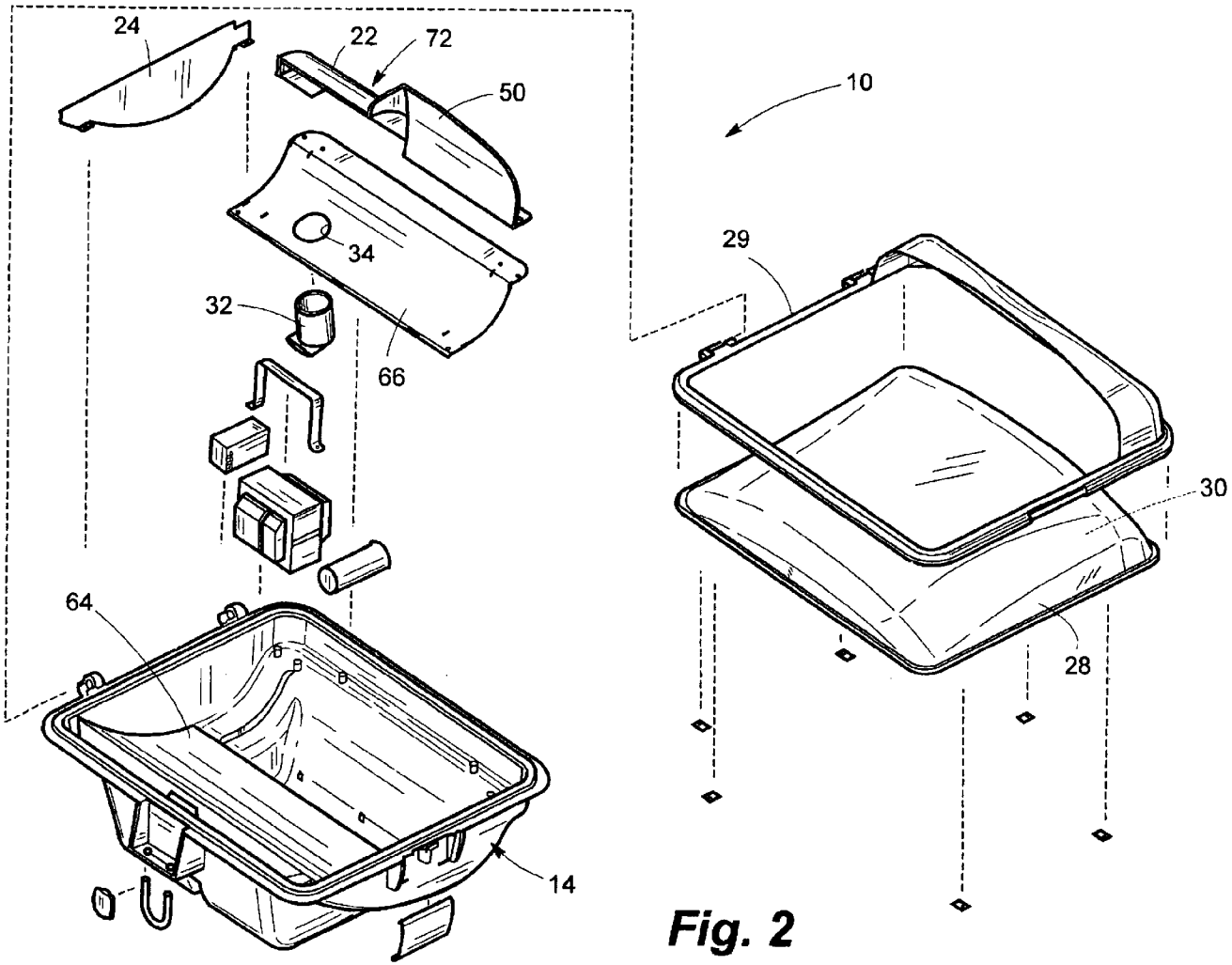
FIG. 2 is an exploded view of the embodiment of the invention of FIG. 1.
Figure 3:
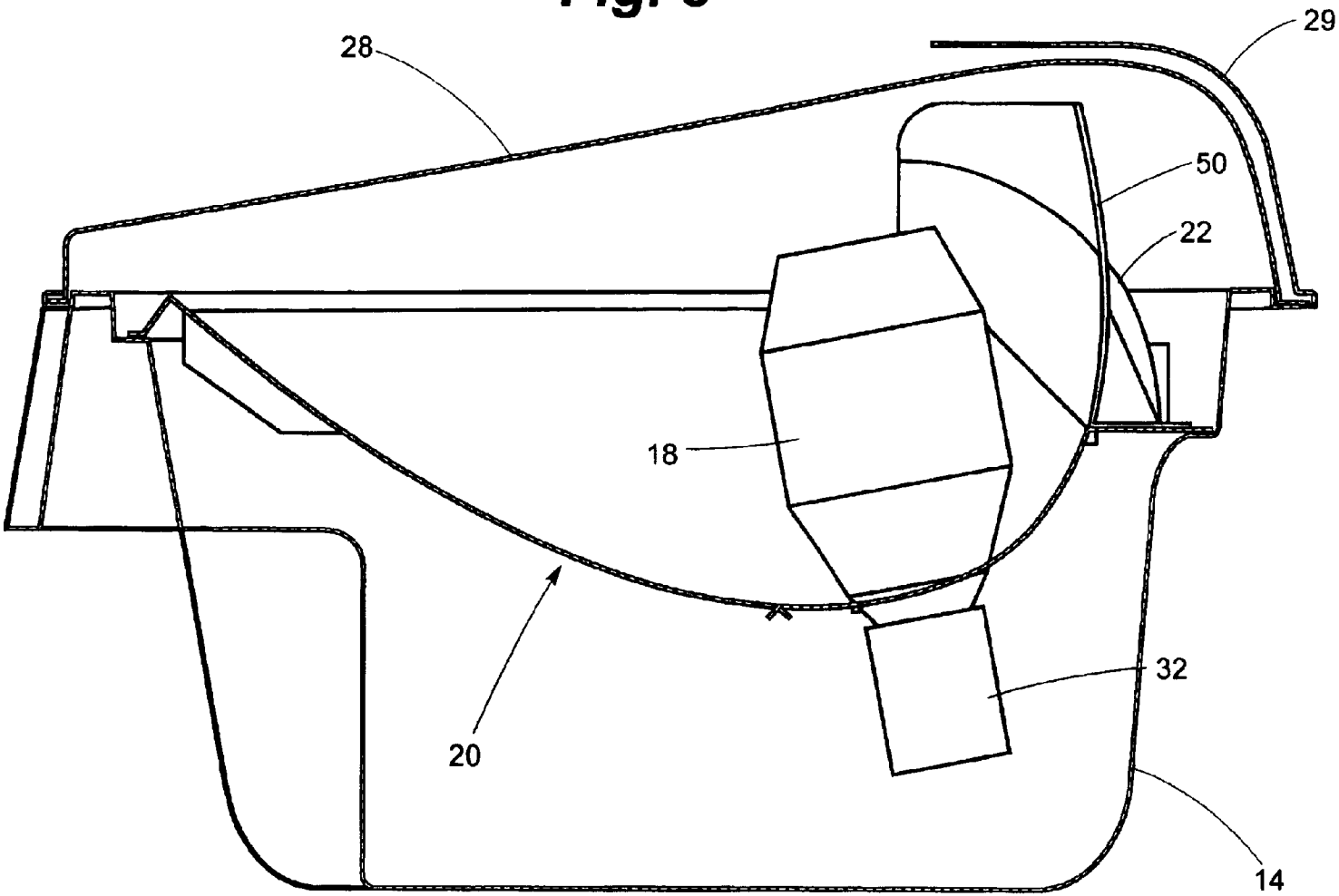
FIG. 3 is a side elevational view in section of the luminaire of FIG. 1.

Referring now to the drawings and particularly to FIGS. 1 through 3, a luminaire configured according to a particular embodiment of the invention is seen at 10, the luminaire 10 being mountable in an essentially conventional manner relative to an outdoor sign, billboard or the like and which typically has a vertical face to be illuminated. The outdoor sign that is to be illuminated by the luminaire 10 is not seen in the drawings for the sake of simplicity. In a typical use environment, a vertical face of a billboard or sign has indicia conveying advertising messages and the like, the luminaire 10 being intended to illuminate the indicia on the vertical face of the sign so that the indicia is legible such as during nighttime hours. The luminaire 10 is mounted in spaced relation to the sign and slightly beneath a lower edge thereof by means of a conventional mounting which can include a support (not shown) that takes the form of a conduit, pipe or the like. Such a support acts to maintain a predetermined distance between the luminaire 10 and the outdoor sign and is configured in a conventional manner to prevent rotation of the luminaire 10 after leveling and tightening of said luminaire 10 onto such support. The luminaire 10 can conveniently be mounted by attachment to such a sign by connection of a support to the luminaire 10 through the agency of a U-shaped mounting element 12 as is conventionally attached to a luminaire housing 14. Positioning of the luminaire 10 relative to a surface of an outdoor sign varies according to particular use situations. Usual practice in the industry requires a spacing of the luminaire 10 from a surface of an outdoor sign at a distance of approximately 60 inches outwardly from a bottom edge of such surface in order to accommodate a maintenance catwalk commonly used for periodic maintenance and indicia changeout.

The luminaire housing 14 receives a reflector assembly 16 and a lamp 18 for connection to a source of electrical power in a conventional manner. The reflector assembly 16 is seen also in an exploded relationship in FIG. 4 to be formed of a main reflector 20 and a secondary reflector 22 which is preferably mounted to the main reflector 20. The reflector assembly 16 also includes reflective side panel 24, the reflector assembly 16 occupying essentially the full surface area of the interior of the housing 14 so that light from the lamp 18 is efficiently directed onto a surface of an outdoor sign or onto a transparent lens 28, the lens 28 being preferably formed of pressed borosilicate glass according to conventional practice and having a series of refractors 30 formed on interior surfaces of said lens 28. The lens 28 could also be formed of acrylic polymeric material as is also conventional in the art. The lens 28 is configured as is conventional in the art to function also as a cover, the lens 28 being mounted by a frame 29 which is hinged to allow access to the interior of the luminaire 10 and to seal the luminaire 10 against the elements as is known in the art. The lamp 18 is mounted by a conventional lamp socket 32 through an opening 34 formed in the main reflector 20. The lamp socket 32 is typically formed of porcelain and is factory prewired and configured for corrosion resistance, safety, positive hold and ease of lamp replacement as is known in the art. In the embodiment shown in FIGS. 1 through 3 inter alia, the lamp 18 is seen to be disposed in a vertical orientation, that is, the longitudinal axis of the lamp 18 is vertically disposed when the luminaire 10 is positioned in an operational environment. The lamp 18 typically takes the form of a metal halide lamp and particularly a pulse metal halide lamp capable of generating approximately 40,000 lumens. A suitable lamp can take the form of a pulse metal halide lamp such as is manufactured by Venture Lighting of Solon, Ohio, such a lamp being of a wattage in a range between 175 and 400 watts and preferably 320 to 400 watts. It is to be understood, of course, that the luminaire 10 could be mounted in orientations other than an exactly vertical orientation or in other positions without departing from the scope of the invention. In the description provided herein, it is to be understood that the use of the term "vertical orientation" refers to an orientation of approximately ±15° from vertical, a preferred mounting being at approximately 80° above horizontal. Essentially, the lamp 18 in a preferred embodiment of the invention is disposed within the housing 14 of the luminaire 10 in an orientation that is substantially vertical or nearly so.

Figure 12:
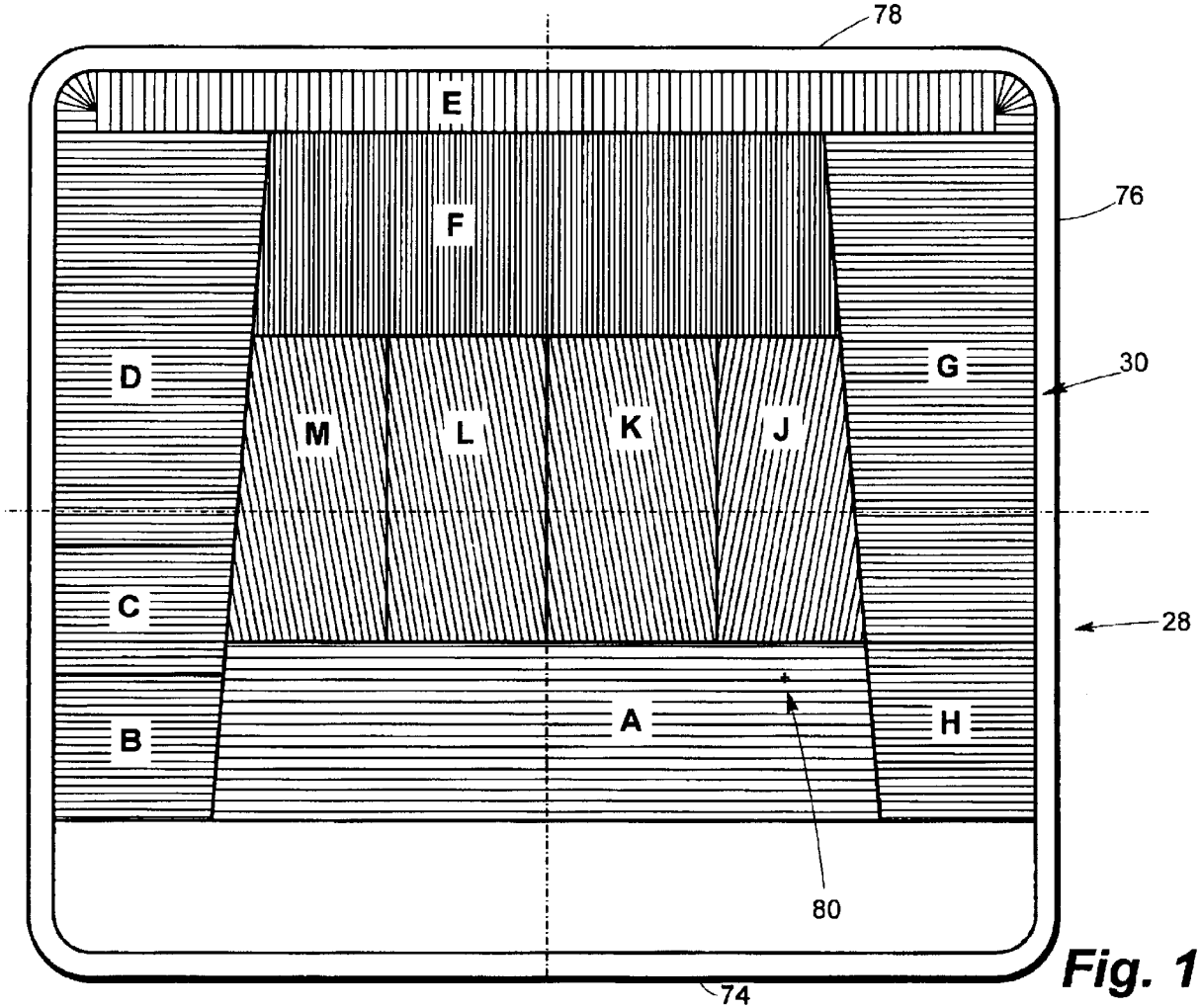
FIG. 12 is an idealized front elevational view illustrating the refractive elements disposed on a lens used on at least certain embodiments of the invention.

The housing 14 includes a body portion 36 that is shaped essentially as a rectangular box dimensioned to accommodate the reflector assembly 16, the housing 14 being open about peripheral side edges 38, 40 and front and back edges 42, 44 respectively, the front edge 42 being that edge disposed nearmost to an outdoor sign or the like. The lens 28 is mounted by the frame 29, the assembly formed by the lens 28 and the frame 29 completing a housing assembly that also includes the housing 14, the frame 29 being open about peripheral edges which mate with the edges 38 through 44 of the housing 14. The lens 28 is seen to slope downwardly over a front face thereof and is seen to have rounded corners, a conformation essentially conventional in the art. The lens 28 provides an aperture through which light generated by the lamp 18 and at least partially reflected by the reflector assembly 16 can exit the luminaire 10. The lens 28 is located to effectively be disposed within the luminaire 10 such that all light passing from the luminaire 10 must pass through the lens 28. Light passing through central portions of the lens 28 is redirected onto vertical surfaces of an outdoor sign by the refractors 30 as will be described hereinafter. The refractors 30 exist as groupings of prisms having differing characteristics depending on location on the lens 28, the prisms preferably being directly formed in the lens 28 and located on interiorly disposed surfaces thereof as is shown particularly in FIG. 12. As is seen in FIG. 12, the lens 28 essentially comprises a body portion 31 which is substantially rectangular or square in conformation with prisms being formed integrally with the body portion 31 of the lens 28. In the art, refractors such as the refractors 30 are referred to as internal prisms when disposed on or formed integrally with interior surfaces of a lens or transparent cover positioned over an aperture of a luminaire. The lens 28 is mounted relative to the housing 14 in a conventional manner so as to prevent leakage of moisture into the interior of the luminaire 10. The material from which the lens 28 is formed is chosen to be thermally shock resistant glass or transparent polymeric material which is not damaged by rain, snow or extreme weather conditions such as heat, direct sunlight, etc. The lens 28 is formed with a smooth outer surface which is effectively self-cleaned by rain.

As indicated above, the housing 14 is completed by joining of the assembly formed of the lens 28 and the frame 29 and is shaped to be essentially volumetrically efficient as well as visually attractive. The housing 14 is provided with a peripheral lip 46 about the edges 38 to 44 which mates with peripheral edges of the frame 29, the lip 46 and the edges of the frame 29 being latchable in a conventional manner to fasten the housing 14 and the lens-bearing frame 29 together to complete an enclosure for an optical assembly that includes the reflector assembly 16 and the lamp 18. Although not shown in the drawings, gaskets are provided between the lip 46 and edges of the frame 29 in a conventional manner to seal the housing 14. Sealing structure (not shown) also seals the lens 28 within the frame 29. A visor can also be formed in the frame 29 as is conventional in the art.

As mentioned hereinabove, the frame 29 is hinged conventionally to the housing 14 so that the frame 29 and the lens 28 carried thereby can act essentially as a door and be pivoted upwardly on unlatching of the frame 29 and the housing 14 to access the interior of the luminaire 10 for maintenance and the like. As is also conventional, the lens 28 supports the refractors 30. As is also conventional in the art, hinge components (not shown) useful for attaching the frame 29 to the housing 14 can be die-cast integrally with said frame 29 and housing 14. Supports (not shown) can be conventionally provided for the frame 29 when the frame 29 is pivoted past vertical such as by an integral cast hinge stop (not shown). The assembly provided by the housing 14 and the lens-bearing frame 29 prevents entry of snow and wind-driven rain into the interior of the luminaire 10, the assembly being UL listed for wet locations and meeting UL 1572 rain test requirements. The luminaire 10 is further configured to mount easily to either new or existing signs through the use of conventional expedients.

Luminaires such as the luminaire 10 configured according to the present invention efficiently function to uniformly illuminate a billboard, outdoor sign or the like by means of novel features including reflective elements formed into novel configurations, such reflective elements functioning in concert with refractor elements disposed on or formed with the lens 28, vertical surfaces being illuminated with high average illuminance of a desirable intensity with minimal light spillage around peripheral edges of such an outdoor sign. The main reflector 20 can be formed into smoothly continuous curvilinear shapes or formed into similar shapes from sections that facilitate formation of the entirety of the main reflector 20. The secondary reflector 22 is preferably mounted to a rearward edge of the main reflector 20 at 48 essentially along the back edge 44 of the housing 14. The secondary reflector 22 is preferably elliptical in shape and is disposed immediately behind the lamp 18, the secondary reflector 22 extending only partially along rearward edge 48. The main reflector 20 is seen to continue upwardly to form an arcuate reflector section 50 laterally of the location of the secondary reflector 22, the reflector assembly 16 causing improvement in light intensity and uniformity over full surfaces of a sign or the like with minimal light spillage about edges thereof. Preferably in combination with the refractors 30 which are of differing orientation and functionality as will be described hereinafter, the reflector assembly 16 at least partially provides the particular operational improvements described herein.

Figure 4:
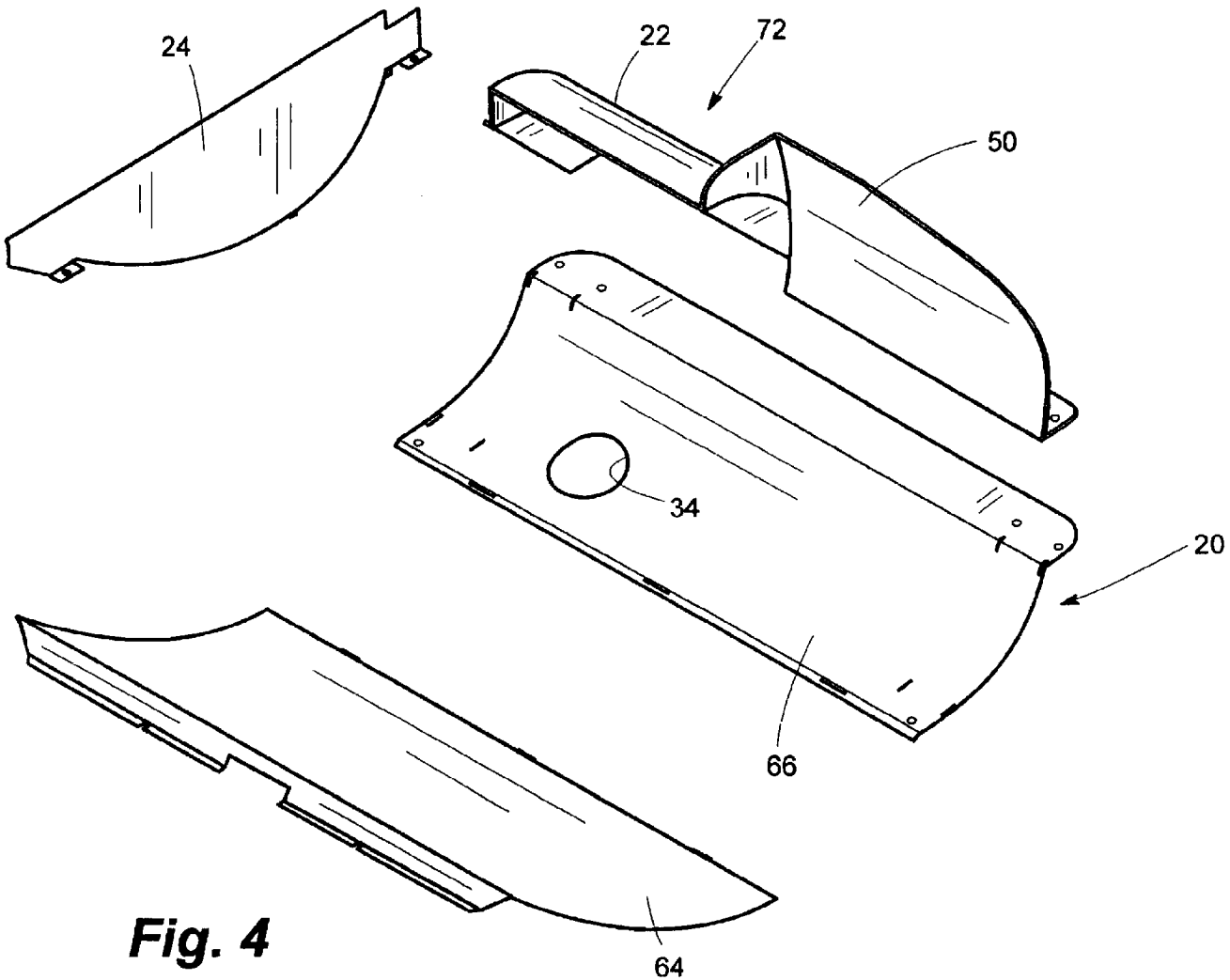
FIG. 4 is an exploded view of a reflector assembly configured according to the embodiment of the invention shown in FIG. 1.
Figure 5:
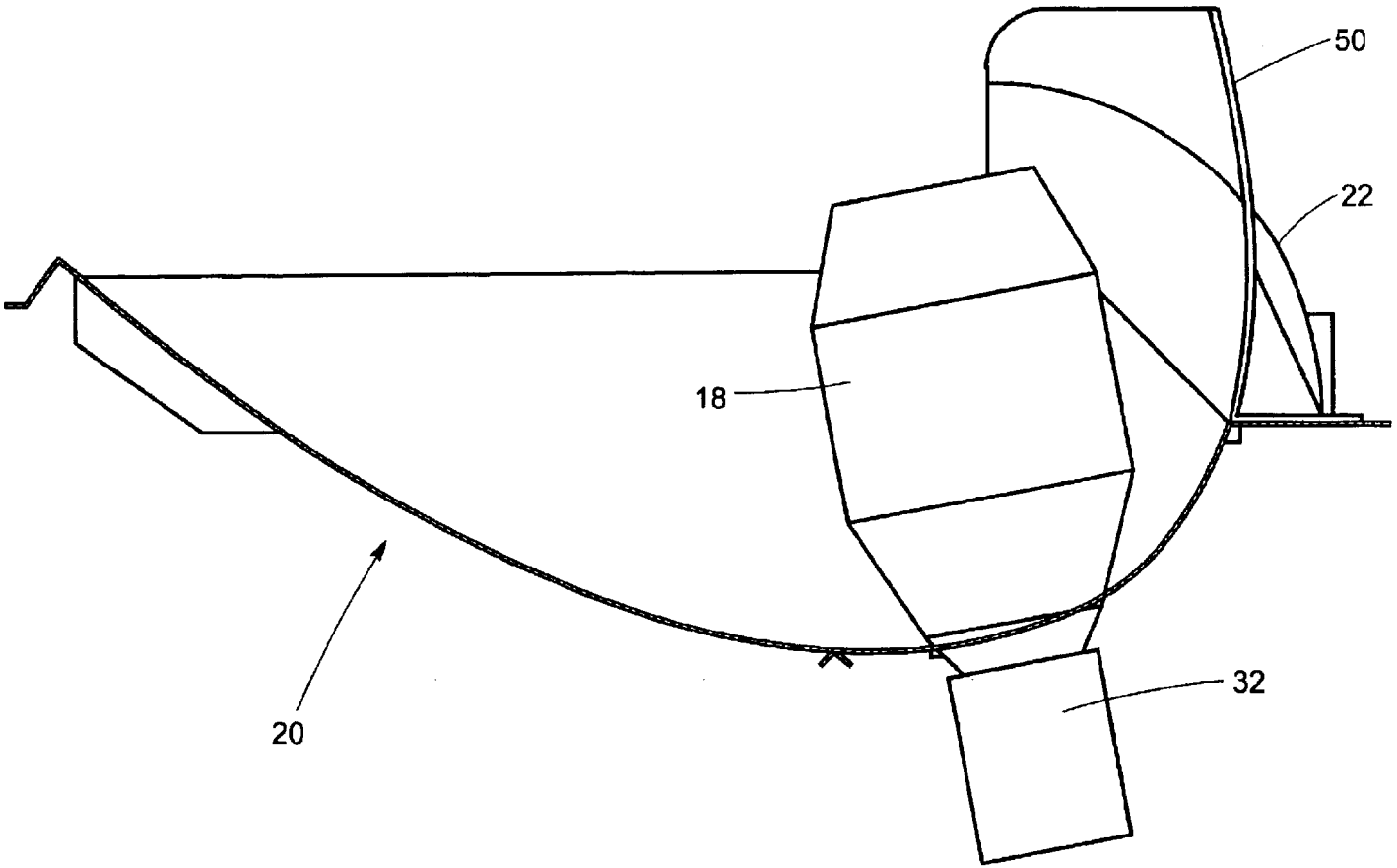
FIG. 5 is a diagrammatical view of a portion of the luminaire of FIG. 1.
Figure 6:
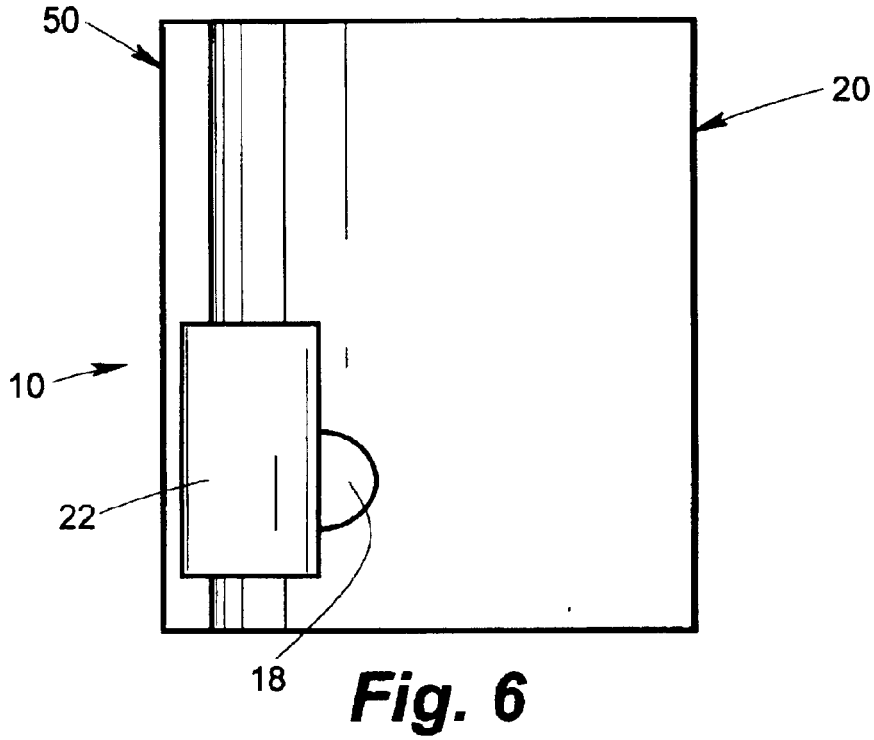
FIG. 6 is an idealized plan view of the reflector assembly of FIG. 1.
Figure 13:
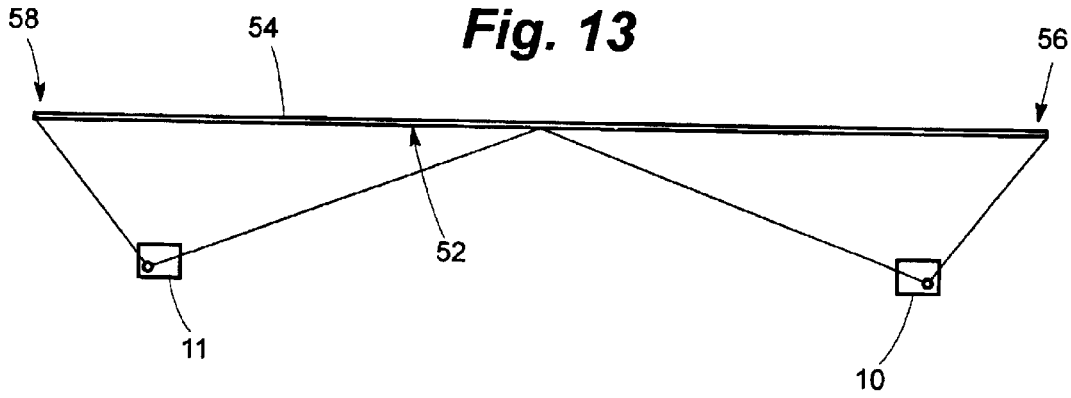
FIG. 13 is a schematic illustrating the use of two luminaires capable of producing asymmetric light distributions to illuminate a typical outdoor sign; and, FIG. 14 is a schematic illustrating the use of two luminaires capable of producing asymmetric light distributions and a luminaire capable of producing a symmetric light distribution to illuminate a typical outdoor sign.

The reflector assembly 16 further includes the reflective side panels 24 and 26 referred to above as best seen in FIGS. 1, 2 and 4. As will be described in greater detail hereinafter, the lamp 18 can be located within the luminaire 10 at positions capable of producing either asymmetric or symmetric light distributions, the embodiment shown in FIG. 1 inter alia producing an asymmetric light distribution by virtue of positioning of the lamp 18 toward one or the other of the side panels 24 or 26. When the lamp 18 is positioned nearmost the side panel 24, the side panel 24 is preferably provided with a high reflectance finish, the opposite side panel 26 being provided either with a high reflectance finish or a low reflectance finish to mitigate spill light. The luminaire 10 configured with the lamp 18 asymmetrically disposed nearmost the side panel 24 and with the secondary reflector 22 located behind the lamp 18 causes light to be directed primarily toward the other side of the luminaire 10 and onto a vertical surface 32 of an outdoor sign 54 or the like as is seen with further reference to FIG. 13. The luminaire 10 so configured can be positioned near an end 56 of the outdoor sign 58 with the side panel 24 disposed outwardly of the resulting arrangement so that light is directed not only toward the end 56 of the sign facing the luminaire 10 but also toward the center of the sign, the light from the luminaire 10 being directed primarily over an area extending from the facing end 56 of the sign 54 to the center of said sign. The luminaire 10 so configured therefore produces an asymmetric light distribution. A second luminaire 11 that is the mirror image of the luminaire 10, that is, is configured with the lamp 18 disposed nearmost the side panel 26 so that light is directed onto an end 58 of the sign 54 and also onto that area lying between said end 58 and the center of the sign 54. The sign 54 can thus be illuminated through the use of only two luminaires, that is, the luminaire 10 and the luminaire 11 that is configured to be the mirror image of the luminaire 10. When the two luminaires 10 and 11 are so employed, a majority of the light generated by said luminaire is directed toward the center of the sign, thereby causing control of spill light at the ends 56, 58 of the sign 54 to be simplified. Since the center of the sign 54 is effectively "elongated" through use of the luminaires 10 and 11, spill light in the direction toward the center of the sign 54 is minimized. Energy consumption is also minimized by virtue of the use of a fewer number of luminaires for a given illumination situation without decrease in performance. Spill light is also reduced as is visual clutter occasioned by the use of a greater number of luminaires.

Figure 7:
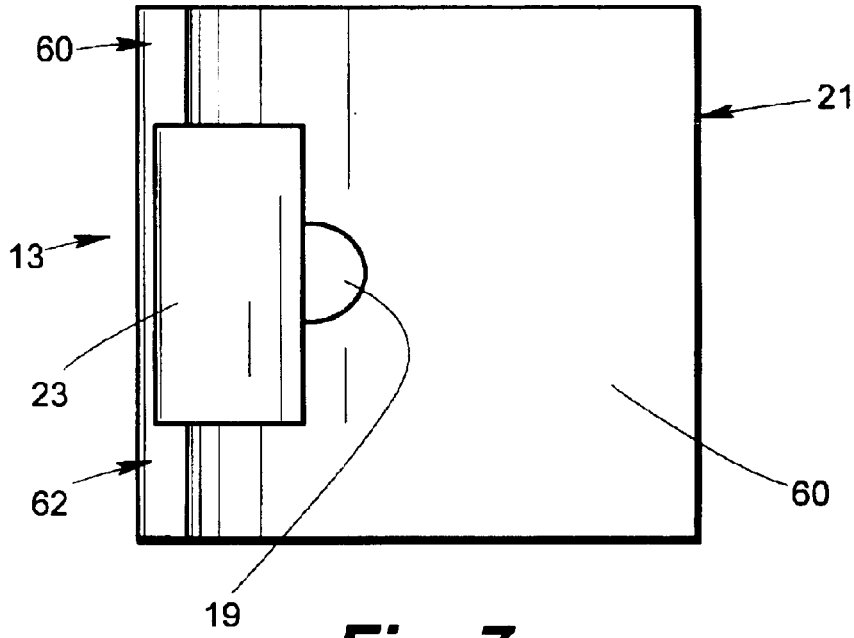
FIG. 7 is an idealized plan view of a portion of a reflector assembly of an embodiment of the invention capable of providing a symmetric light distribution.
Figure 14:
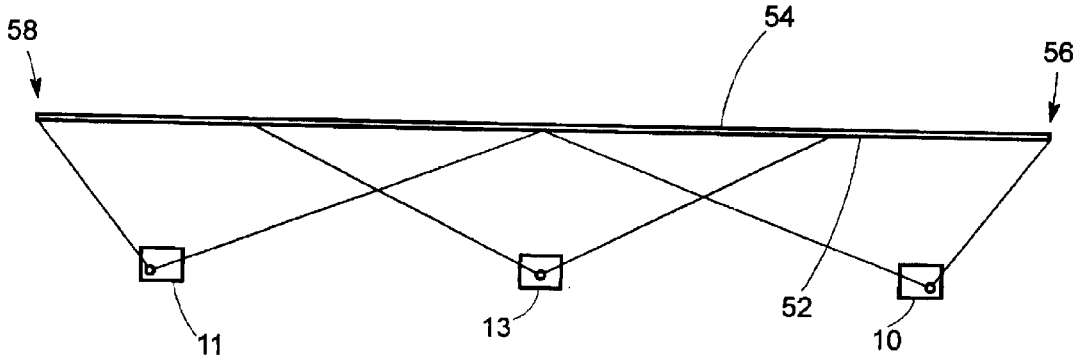

Referring now again to FIG. 14, an illumination situation is illustrated wherein a luminaire 13 capable of producing a symmetric light distribution is located between the luminaires 10, 11 disposed at ends of the sign 54. The luminaire 13 is configured as is shown in FIG. 7 with a lamp 19 disposed equidistantly between sides of the luminaire 13, that is, essentially centrally of the luminaire 13, the luminaire 13 being otherwise configured similarly to the luminaire 10. In the luminaire 13, a secondary reflector 23 is located immediately behind the lamp 19 and mounted centrally along a rear edge of a main reflector 21. Sections 60 and 62 of the main reflector 21 on either side of the secondary reflector 23 extend upwardly from each end of the main reflector 21 and function essentially as does the section 50 of the luminaire 10 as described herein. Use of the "symmetric" luminaire 13 in combination with the "asymmetric" luminaires 10 and 11 allows a greater light level to be directed against central portions of the sign 54. The luminaire 13 is also preferably configured with reflective side panels (not shown) configured essentially identically to the side panels 24 and 26 of the luminaire 10, reflective surfaces of the panels 24, 26 being preferably formed of a high reflectance finish.

Figure 8:
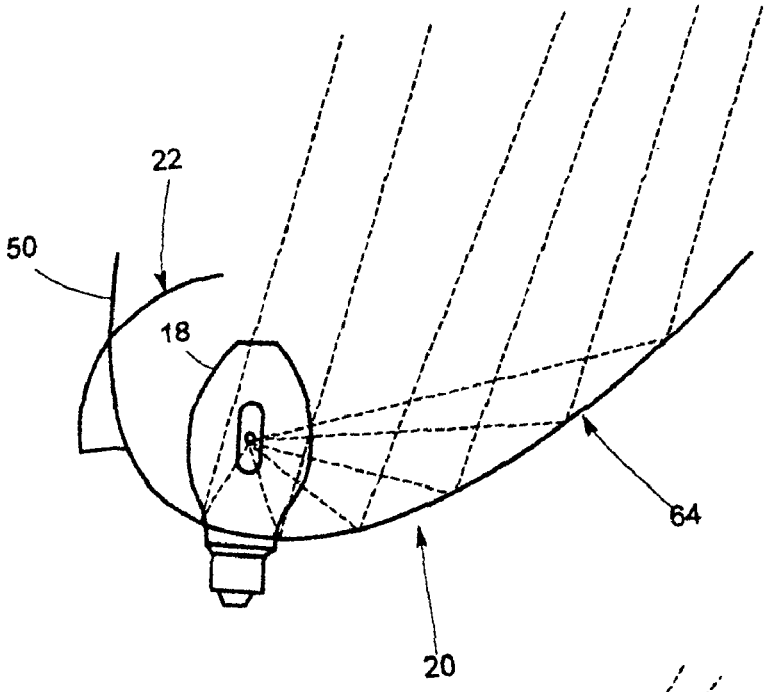
FIG. 8 is a schematic illustrating the function of a portion of a main reflector of the several configurations of the invention.
Figure 9:
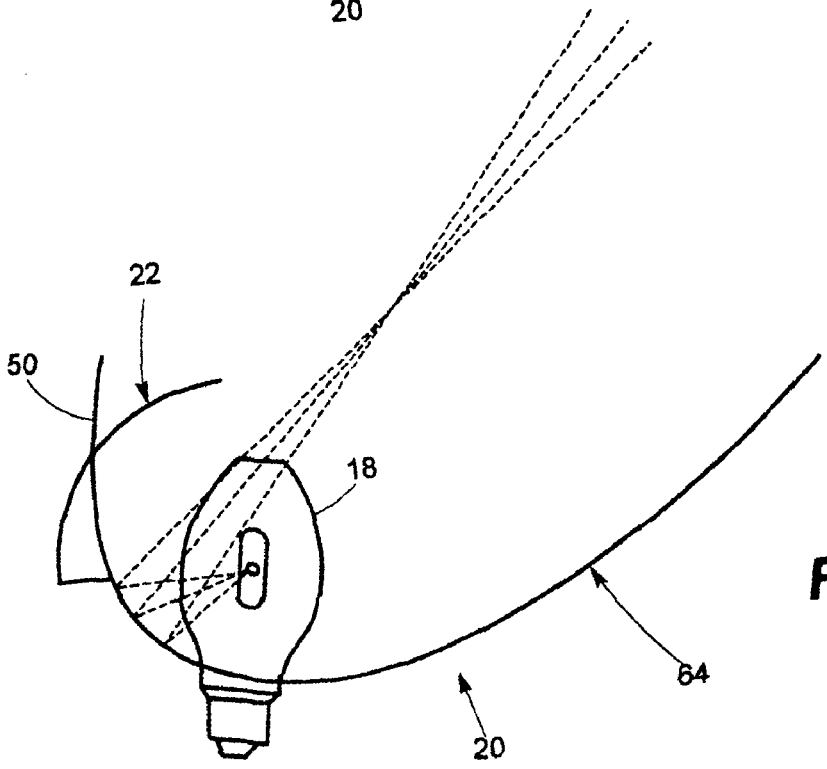
FIG. 9 is a schematic illustrating the function of another portion of a main reflector of the several configurations of the invention.
Figure 10:
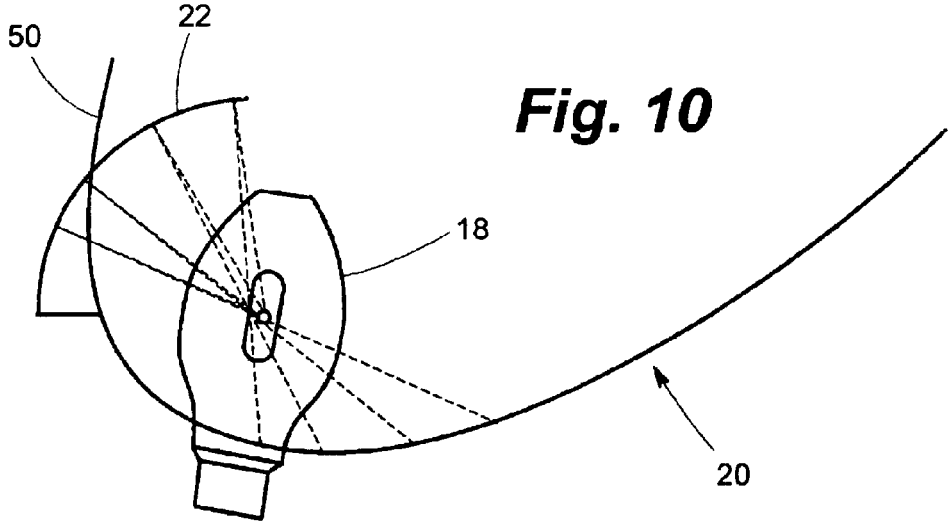
FIG. 10 is a schematic illustrating the function of a portion of a secondary reflector of the several configurations of the invention.
Figure 11:
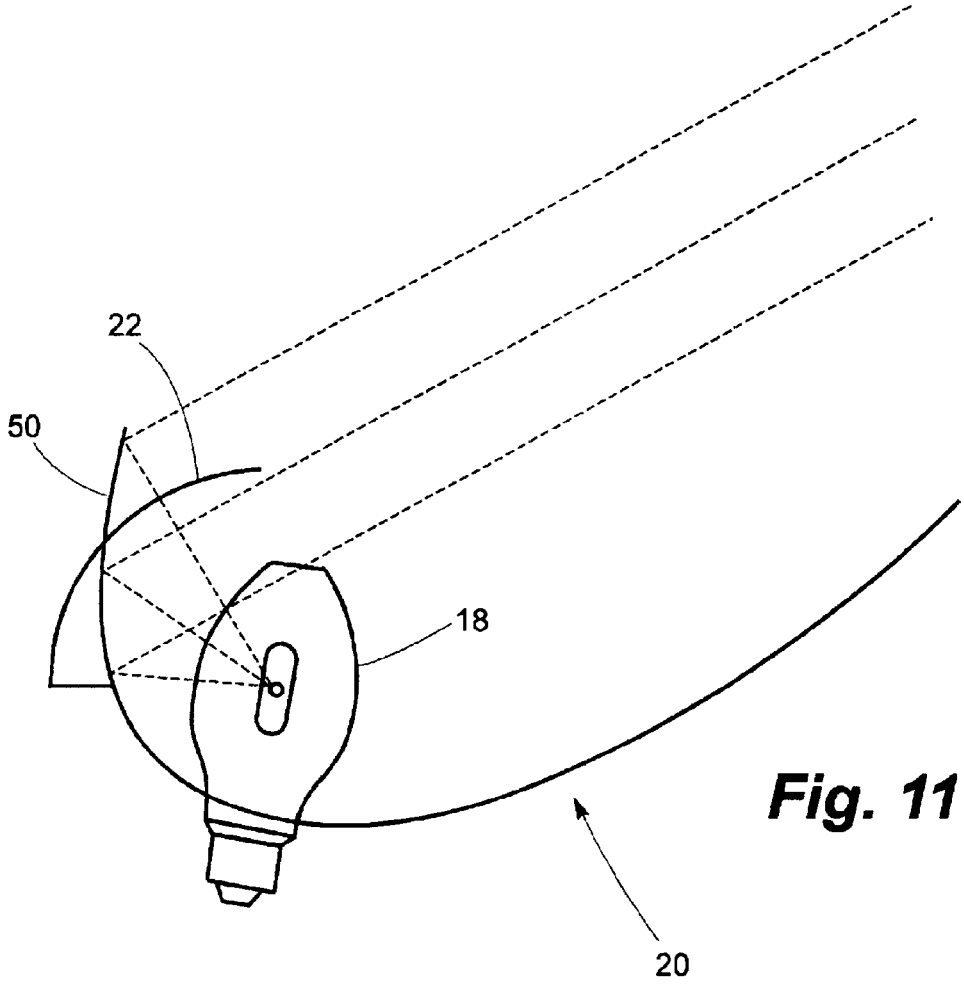
FIG. 11 is a schematic illustrating the function of another portion of a secondary reflector of the several configurations of the invention.

Referring now also to FIG. 4, the reflector assembly 16 of the luminaire 10 is seen as described herein to be configured with dual reflectors, that is, the main reflector 20 and the secondary reflector 22. The main reflector 20 is formed of sections 64 and 66, the sections 64, 66 having a highly specular finish and being joinable together along opposing lateral edges 68 and 70 through the use of appropriate fasteners (not shown). The sections 64, 66 when assembled have a curvilinear shape which reflects light as is shown diagrammatically in FIGS. 8 and 9. The section 64 essentially aims light toward top portions of a sign such as the sign 54 of FIGS. 13 and 14, the center of an arc tube 17 with the lamp 18 being reflected just below the top edge of the sign 54 as seen in FIG. 8. The section 66 located directly below the lamp 18 also illuminates the top edge of the sign 54 as is seen in FIG. 9. A maximum amount of light is thus directed to the top of the sign 54 but with a minimum of spill light. The secondary reflector 22 is preferably formed in an elliptical shape so that light is distributed over lower portions of the sign 54 as can be inferred from the diagram of FIGS. 10 and 11.

With continuing reference to FIG. 4 inter alia, the reflector assembly 16 is further seen to be configured with a section 72 that includes the secondary reflector 22 and the reflective section 50. The section 72 is assembled to the section 66 by means of appropriate fasteners (not shown), the section 50 having a parabolic contour that continues the curvilinear contours of the sections 64 and 66. The section 50 is disposed adjacent to the secondary reflector 22, the secondary reflector 22 being disposed directly behind the lamp 18. The elliptical secondary reflector 22 creates a unified lamp image immediately below the arc tube 17 as can be seen with reference to FIG. 10. The parabolic section 50 reflects light toward the lower center portion of the sign 54 as can be inferred from FIG. 11. The main reflector 21 of the "symmetric" luminaire 13 and as is best seen in FIG. 7 is similarly configured with the exception that the sections 60, 61 are disposed one each on each side of the centrally disposed secondary reflector 23, said sections 60, 61 and the secondary reflector 23 functioning to direct light essentially in the manner referred to herein relative to the functioning of the section 50 of the main reflector 20 and of the secondary reflector 22.

Referring now to FIG. 12, the lens 28 so illustrated is understood to be formed of borosilicate glass or a plastic material such as an acrylic material as is conventional in the art. The refractors 30 comprise groupings of prisms formed integrally on interior surfaces of the lens 28, the refractors 30 functioning to improve the uniformity of light directed onto a vertical surface of a sign such as the sign 54 of FIGS. 13 and 14. The refractors 30 function to capture light that would not normally be directed onto the sign 54 and that would be lost if not redirected. While configurations of the invention can utilize a non-prismatic lens, it is to be understood that the lens 28 configured with the refractors 30 as disclosed herein provides a luminaire having improved performance. As seen in FIG. 12, that edge identified hereinafter as edge 78 of the lens 28 located along the upper portion of the drawing is the edge disposed nearmost the sign 54. The location of the lamp 18 beneath the lens 28 in the luminaire 10 has its center at 80. The luminaire 11, the mirror image of the luminaire 10, not only has the location of a lamp such as the lamp 18 located near the opposite end of the luminaire 11 relative to the conformation of the luminaire 10, but also has the refractors 30 formed as a mirror image of the lens 28 as said lens is seen in FIG. 12. In other words, description of the luminaire 11 as the mirror image of the luminaire 10 is not merely a matter of relocation of the position of the lamp 18.

With further reference to FIG. 12, the refractors 30 are seen to be grouped into sections covering in total major portions of the interior surface of the lens 28, the sections being identified as Sections A through H and J through M, prisms forming each of said sections being schematically represented since a schematic rendering of the structure so illustrated provides more information than would a view of actual prisms or groupings of prisms. As seen in FIG. 12, the sections A, H and B are located in spaced relation to an edge 74 of the lens 28, the section A being centrally disposed between the sections B and H and being of a greater length than said sections B and H. Thus, sections J, K. L and M are located immediately above the section A and contiguous along lower edges thereof to an upper edge of the section A, the sections J, K. L and M being sequentially contiguous along lateral edges. The section G is disposed above the section H and along an outer edge 76 of the lens 28, the section G being contiguous to the section J along inner edges of said section G. The section C is disposed above the section B and contiguous thereto, the section C contacting portions of the section A and of the section M on inner edges thereof The section D lies above the section C and contiguous thereto and to portions of the section M, upper inner edges of the section D contacting an edge of the section F which extends across the lens 28 to contact the section G. The section E lies along edge 78 of the lens 28 and extends thereacross in contact with edges of the sections D, F and G respectively. The prisms forming the several sections are cut full within the sections with the prisms being run out in adjacent sections.

The prisms used to form the sections noted above can be formed with curved faces with specific shapes such as are known in refractive elements previously used in the art and produced by Holophane of Newark, Ohio, such prisms being particularly capable of diffusing light to avoid light streaks. The sections A and H direct light that would otherwise not be incident on the sign 54 onto edges thereof, the section A directing light onto top edges of the sign while the section H directs light onto an end of the sign. Sections B and C direct light from an end of the sign 54 toward central portions of the sign. Sections D, E, F and G act to produce a smooth distribution of light on the sign 54 and primarily function to reduce bright spots on the sign. Sections L and M act to direct toward the middle of the sign 54 while sections J and K smooth out light directed onto central portions of the sign 54 at a location where a lamp shadow created by the arc tube of the lamp 18 would otherwise occur.

Although the invention has been explicitly described herein relative to several embodiments thereof, it is to be understood that the particular embodiments shown and described herein are illustrative of the invention and not limiting thereof. Accordingly, the scope of the invention is defined by the recitations of the appended claims.

What is claimed is:

1. A luminaire adapted to illuminate a surface of a panel, comprising:

a lamp housing;

a lamp disposed within the lamp housing; and, reflector means mounted within the lamp housing for directing light generated by the lamp onto the surface of the panel in an asymmetric distribution.

2. The luminaire of claim 1 and further comprising:

a refractor affixed to the lamp housing, the refractor cooperating with the reflector means to direct light from the lamp and the reflector means onto the surface of the panel, thereby resulting in increased uniformity of light on the surface and a reduction in the amount of light which misses the surface.

3. The luminaire of claim 1 wherein the lamp is vertically oriented within the lamp housing.

4. The luminaire of claim 3 wherein the reflector means comprises:

a main reflector having a curvilinear reflective surface; and, a secondary reflector carried by the housing and mounted behind the lamp.

5. The luminaire of claim 4 wherein the reflective surfaces of the main reflector are parabolic in contour.

6. The luminaire of claim 4 wherein reflective surfaces of the secondary reflector are elliptical in contour.

7. The luminaire of claim 4 and further comprising a reflective side panel disposed along at least one lateral edge of the main reflector.

8. The luminaire of claim 7 wherein the reflective side panel has a high reflectance finish.

9. The luminaire of claim 8 wherein the lamp is disposed in proximity to the reflective side panel.

10. A luminaire adapted to illuminate a surface of a panel, comprising:

a lamp housing;

a lamp disposed within the lamp housing; and, a reflector assembly mounted within the lamp housing, the reflector assembly comprising a main reflector having a curvilinear reflective surface and a secondary reflector carried by the housing and mounted behind the lamp, edges of the secondary reflector opposing edges of the main reflector being of lesser length than said edges of the main reflector, said edges of the secondary reflector being disposed only behind and in proximity to the lamp.

11. The luminaire of claim 10 wherein the lamp is vertically oriented within the lamp housing.

12. The luminaire of claim 11 wherein the lamp is more closely spaced relative to one side of the housing, light generated by the lamp being directed onto the surface of the panel in an asymmetrical distribution.

13. The luminaire of claim 12 wherein the reflective surfaces of the main reflector are parabolic in contour.

14. The luminaire of claim 12 wherein the reflective surfaces of the secondary reflector are elliptical in contour.

15. The luminaire of claim 12 and further comprising a reflective side panel disposed along each lateral edge of the main reflector.

16. The luminaire of claim 15 wherein the reflective side panel disposed nearmost the lamp has a high reflective finish.

17. The luminaire of claim 16 wherein the reflective side panel disposed opposite the panel nearmost the lamp has either a high reflectance finish or a low reflectance finish.

18. The luminaire of claim 11 wherein the lamp is disposed within the lamp housing equidistantly from side edges of said luminaire, light generated by the lamp being directed onto the surface of the panel in a symmetric distribution.

19. The luminaire of claim 11 and further comprising:

a refractor affixed to the lamp housing, the refractor cooperating with the reflector assembly to direct light from the lamp and the reflector assembly onto the surface of the panel, thereby resulting in increased uniformity of light on the surface and a reduction in the amount of light which misses the surface.

20. A system for illuminating an outdoor sign of substantially rectangular dimensions and of a width-wise dimension requiring the use of multiple luminaires for illumination of end portions of the sign and a central portion of the sign, comprising;

a luminaire spaced from the sign and in opposing relation to a lower edge of the sign at each end of the sign, the luminaires each being formed of a housing, a lamp mounted within the housing and a reflector assembly mounted within the housing for reflecting light from the lamp and incident on the reflector to either a vertical surface of the sign or to other portions of the luminaire, the lamp of each of the luminaires being vertically disposed within each of said housings and located more closely spaced to an outward side of each of said luminaires, thereby to produce an asymmetrical distribution of light on the sign to uniformly illuminate the sign with minimal light spillage about edges of the sign.

21. A luminaire adapted to illuminate a surface of a panel, comprising:

a lamp housing;

a lamp disposed within the lamp housing; and, reflector means mounted within the lamp housing for directing light generated by the lamp onto the surface of the panel in an asymmetric distribution, the reflector means comprising a main reflector having a curvilinear reflective surface and a secondary reflector carried by the housing and mounted behind the lamp.

22. The luminaire of claim 21 and further comprising:

a refractor affixed to the lamp housing, the refractor cooperating with the reflector means to direct light from the lamp and the reflector means onto the surface of the panel, thereby resulting in increased uniformity of light on the surface and a reduction in the amount of light which misses the surface.

23. The luminaire of claim 21 wherein the lamp is vertically oriented within the lamp housing.

24. The luminaire of claim 21 wherein the reflective surfaces of the main reflector are parabolic in contour.

25. The luminaire of claim 21 wherein reflective surfaces of the secondary reflector are elliptical in contour.

26. The luminaire of claim 21 and further comprising a reflective side panel disposed along at least one lateral edge of the main reflector.

27. The luminaire of claim 26 wherein the reflective side panel has a high reflectance finish.

28. The luminaire of claim 27 wherein the lamp is disposed in proximity to the reflective side panel.

29. The luminaire of claim 21 wherein the lamp is more closely spaced relative to one side of the housing.

30. A luminaire adapted to illuminate a surface of a panel, comprising:

a lamp housing;

a lamp disposed within the lamp housing; and, a reflector assembly mounted within the lamp housing, the reflector assembly comprising a main reflector having a curvilinear reflective surface and a secondary reflector carried by the housing and mounted behind the lamp, the lamp being more closely spaced relative to one side of the housing, light generated by the lamp being directed onto the surface of the panel in an asymmetrical distribution.

31. The luminaire of claim 30 wherein the lamp is vertically oriented within the lamp housing.

32. The luminaire of claim 30 wherein the reflective surfaces of the main reflector are parabolic in contour.

33. The luminaire of claim 30 wherein the reflective surfaces of the secondary reflector are elliptical in contour.

34. The luminaire of claim 30 and further comprising a reflective side panel disposed along each lateral edge of the main reflector.

35. The luminaire of claim 34 wherein the reflective side panel disposed nearmost the lamp has a high reflective finish.

36. The luminaire of claim 35 wherein the reflective side panel disposed opposite the panel nearmost the lamp has either a high reflectance finish or a low reflectance finish.

37. The luminaire of claim 30 wherein the lamp is disposed within the lamp housing equidistantly from side edges of said luminaire, light generated by the lamp being directed onto the surface of the panel in a symmetric distribution.

38. The luminaire of claim 30 and further comprising:

a refractor affixed to the lamp housing, the refractor cooperating with the reflector assembly to direct light from the lamp and the reflector assembly Onto the surface of the panel, thereby resulting in increased uniformity of light on the surface and a reduction in the amount of light which misses the surface.

39. A luminaire adapted to illuminate a surface of a panel, comprising:

a lamp housing;

a lamp disposed in a vertical orientation within the lamp housing; and, a reflector assembly mounted within the lamp housing, the reflector assembly comprising a main reflector having a curvilinear reflective surface and a secondary reflector carried by the housing and mounted behind the lamp, the lamp being more closely spaced relative to one side of the housing, light generated by the lamp being directed onto the surface of the panel in an asymmetrical distribution.

40. The luminaire of claim 39 wherein the reflective surfaces of the main reflector are parabolic in contour.

41. The luminaire of claim 39 wherein the reflective surfaces of the secondary reflector are elliptical in contour.

42. The luminaire of claim 39 and further comprising a reflective side panel disposed along each lateral edge of the main reflector.

43. The luminaire of claim 42 wherein the reflective side panel disposed nearmost the lamp has a high reflective finish.

44. The luminaire of claim 43 wherein the reflective side panel disposed opposite the panel nearmost the lamp has either a high reflectance finish or a low reflectance finish.

45. The luminaire of claim 39 and further comprising:

a refractor affixed to the lamp housing, the refractor cooperating with the reflector assembly to direct light from the lamp and the reflector assembly onto the surface of the panel, thereby resulting in increased uniformity of light on the surface and a reduction in the amount of light which misses the surface.

46. A luminaire adapted to illuminate a surface of a panel comprising:

a lamp housing;

a lamp disposed within the lamp housing; and, a reflector assembly mounted within the lamp housing, the reflector assembly comprising a main reflector having a curvilinear reflective surface and a secondary reflector carried by the housing and mounted behind the lamp, the lamp being disposed equidistantly from side edges of said luminaire, light generated by the lamp being directed onto the surface of the panel in a symmetric distribution, the secondary reflector being of a lesser length relative to the length of the main reflector.

47. A luminaire adapted to illuminate a surface of a panel, comprising:

a lamp housing;

a lamp disposed within the lamp housing;

reflector means mounted within the tamp housing for direction light generated by the lamp onto the surface of the panel in an asymmetric distribution, the reflector means comprising a main reflector having a curvilinear reflective surface and a secondary reflector carried by the housing and mounted behind the lamp; and, a reflective side panel disposed along at least one lateral edge of the main reflector, the lamp being disposed in proximity to the reflective side panel.

48. The luminaire of claim 47 and further comprising:

a refractor affixed to the lamp housing, the refractor cooperating with the reflector means to direct light from the lamp and the reflector means onto the surface of the panel, thereby resulting in increased uniformity of light on the surface and a reduction in the amount of light which misses the surface.

49. The luminaire of claim 47 wherein the lamp is vertically oriented within the lamp housing.

50. The luminaire of claim 47 wherein the reflective surfaces of the main reflector are parabolic in contour.

51. The luminaire of claim 50 wherein reflective surfaces of the secondary reflector are elliptical in contour.

52. The luminaire of claim 47 wherein the reflective side panel has a high reflectance finish.

* * * * *